US007162186B2

(12) United States Patent
Moritani

(10) Patent No.: US 7,162,186 B2
(45) Date of Patent: Jan. 9, 2007

(54) IMAGE FORMING APPARATUS INCLUDING A ROTARY MEMBER HAVING A ⊃ SHAPED CROSS SECTION DRIVE CONNECTING MEMBER

(75) Inventor: Toshifumi Moritani, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 539 days.

(21) Appl. No.: 10/670,243

(22) Filed: Sep. 26, 2003

(65) Prior Publication Data

US 2004/0062571 A1 Apr. 1, 2004

(30) Foreign Application Priority Data

Sep. 30, 2002 (JP) ..... 2002-286917

(51) Int. Cl.
*G03G 15/01* (2006.01)

(52) U.S. Cl. ..... 399/227

(58) Field of Classification Search ..... 399/107, 399/110, 119, 222, 226, 227
See application file for complete search history.

(56) References Cited

U.S. PATENT DOCUMENTS

| | | | | |
|---|---|---|---|---|
| 5,617,198 | A | 4/1997 | Ishikawa et al. | 399/27 |
| 6,834,173 | B1 * | 12/2004 | Yamaguchi et al. | 399/119 |
| 6,941,097 | B1 * | 9/2005 | Toba et al. | 399/227 |
| 6,983,115 | B1 * | 1/2006 | Isobe et al. | 399/119 |

FOREIGN PATENT DOCUMENTS

| | | |
|---|---|---|
| CN | 1115423 A | 1/1996 |
| JP | 2-6971 | 1/1990 |
| JP | 6-317982 | 11/1994 |
| JP | 8-101599 | 4/1996 |
| JP | 10-319672 | 12/1998 |
| JP | 2000-82881 | 3/2000 |
| JP | 2001-209225 | 8/2001 |
| JP | 2002-258615 | 9/2002 |

OTHER PUBLICATIONS

Japanese Office Action, Application No. 2002-286917, dated Jan. 10, 2006.

* cited by examiner

*Primary Examiner*—Hoan Tran
(74) *Attorney, Agent, or Firm*—Fitzpatrick, Cella, Harper & Scinto

(57) ABSTRACT

An image forming apparatus includes an image bearing member. First and second developing devices developing a latent image formed on the image bearing member. A rotary member holds the first and second developing device. First and second drive receiving parts are provided at first and second side plates at opposite end portions in a longitudinal direction of the rotary member. A rotary shaft includes first and second drive transmitting parts engaged with the first and second drive receiving parts. A driving source drives the rotary shaft, which is rotated by driving power is transmitted to the first and second drive receiving parts and the rotary member is rotated. The rotary member includes a connecting member which has a "⊃" shaped section for connecting a center of the first side plate and a center of the second side plate.

7 Claims, 3 Drawing Sheets

IMAGE FORMING APPARATUS INCLUDING A ROTARY MEMBER HAVING A ⊃SHAPED CROSS SECTION DRIVE CONNECTING MEMBER

BACKGROUND OF THE INVENTION

1. Field of the Invention

The present invention relates to an image forming apparatus such as a copying machine and a printer using electrophotographic recording technology and electrographic recording technology, and particularly to an image forming apparatus having a developing device changing rotary.

2. Related Background Art

As image forming apparatuses capable of outputting color images with use of toners of a plurality of colors, there are a developing device changing rotary type which has a rotary holding a plurality of developing devices and switching the developing devices opposing to a photosensitive member by rotating the rotary, a tandem type in which a plurality of photosensitive members are aligned, and the like.

The developing device changing rotary type has the advantage that the photosensitive member does not need to be provided for each color and the apparatus can be made compact, and the tandem type has the advantage of being capable of printing at a high speed because it can perform parallel processing of toner image formation onto each photosensitive member. Each type has its own advantages and disadvantages, and the types are selected in accordance with the concepts of products.

FIG. 3 is a perspective view of a changing rotary mounted on the developing device changing rotary type of image forming apparatus which becomes a reference for understanding the present invention. FIG. 3 shows the state, in which developing cartridges are removed from the rotary, and in an actual state of use, four developing cartridges are attached to the rotary.

Circular discs 107 and 110 are placed at both ends in a longitudinal direction of the rotary, and both discs are connected by a plurality of metal reinforcing stays 112 (four in this example). These four stays allow the rotary to have torsional rigidity. A gear 107*a* is provided at a side of the disc 107, and power of a motor 101 is transmitted to the gear 107*a* via gears 102 to 106, whereby the rotary is rotated.

When the rotary is rotated by transmitting the power to the gear 107*a* provided at only one side of the rotary like this, it is necessary to secure sufficient rigidity so that the rotary is not twisted. Accordingly, a number of reinforcing stays are necessary as described above, the number of components is increased, and the weight is also increased. In addition, it is necessary to bring both the discs 107 and 110 accurately in phase with each other at the stage of manufacture of the single body of the rotary, and therefore the manufacture cost is increased.

SUMMARY OF THE INVENTION

The present invention is made in view of the aforementioned problem, and its object is to provide an image forming apparatus having a developing device changing rotary with a small number of components.

Another object of the present invention is to provide an image forming apparatus having a developing device changing rotary with the weight being reduced.

Still another object of the present invention is to provide an image forming apparatus having a developing device changing rotary which operates normally even with the rotary with low rigidity.

Another object of the present invention is to provide an image forming apparatus having an image bearing member; first developing means for developing a latent image formed on the image bearing member; second developing means for developing a latent image formed on the image bearing member; a rotary member for holding the first and second developing means, with a first drive receiving part being provided at a first side plate at one end portion in a longitudinal direction of said rotary member, and a second drive receiving part being provided at a second side plate at the other end portion; a rotary shaft having a first drive transmitting part engaged with the first drive receiving part, and a second drive transmitting part engaged with the second drive receiving part; and a driving source for driving the rotary shaft; wherein when the rotary shaft is rotated by power of the driving source, the power is transmitted to the first and second drive receiving parts and the rotary member is rotated.

Further objects of the present invention will become apparent by reading the following detailed explanation with reference to the accompanying drawings.

DESCRIPTION OF THE PREFERRED EMBODIMENTS

A preferred embodiment of the present invention will be explained in detail below with reference to the drawings. The sizes, materials, shapes and the relative placements of the components described in this embodiment do not intend to limit the scope of this invention only to them, as long as the specific description is not especially made.

An image forming apparatus according to the embodiment of the present invention will be explained with the use of FIG. 1 and FIG. 2.

Figure 1:
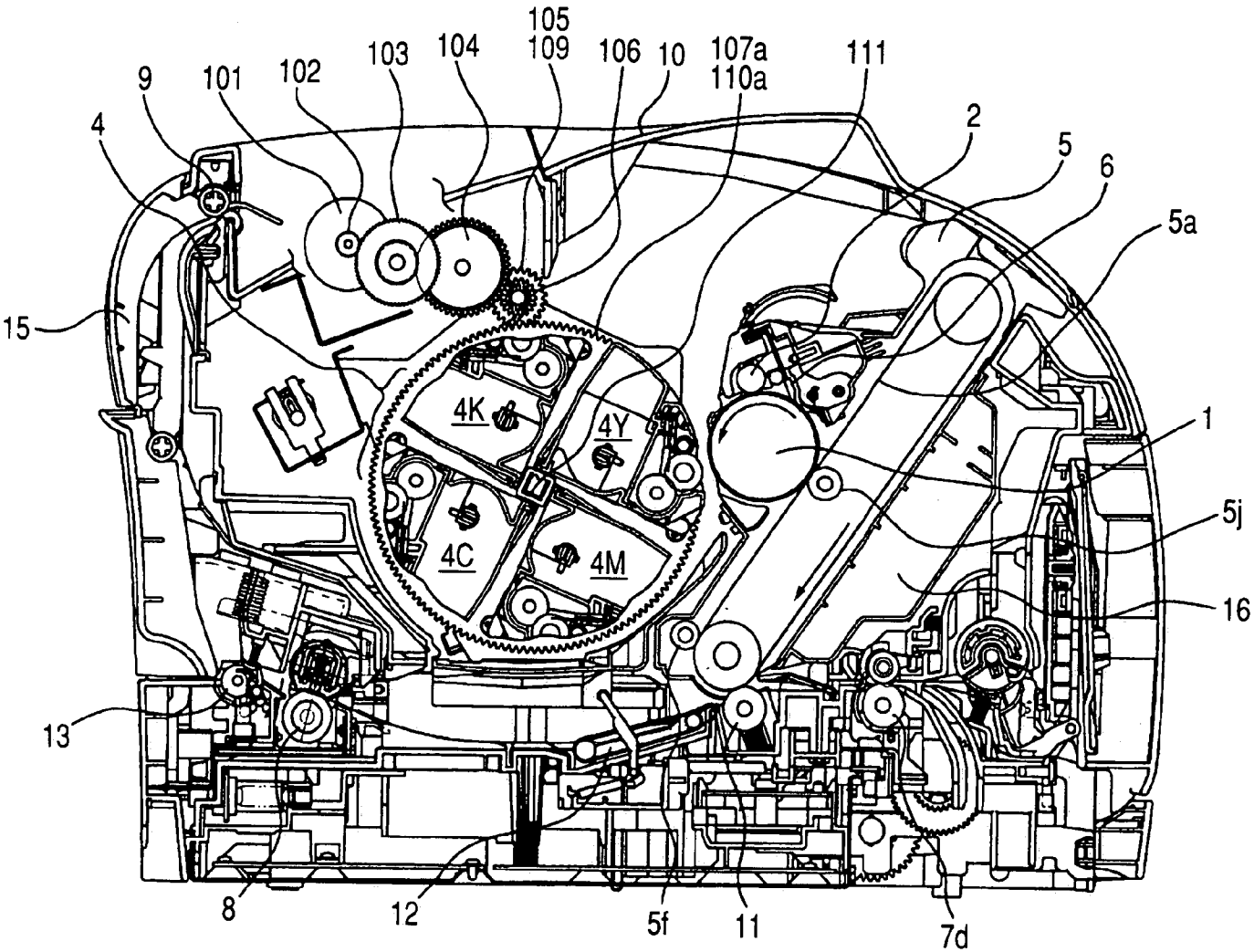
FIG. 1 is a longitudinal sectional view of an electrophotographic type of color image forming apparatus according to an embodiment of the present invention.

The image forming apparatus according to the embodiment of the present invention is a four full-color laser beam printer, and FIG. 1 is a longitudinal sectional view showing a schematic construction thereof.

First, an image forming operation of this color image forming apparatus will be explained.

A photosensitive member drum 1 being an image bearing member is rotated in a direction of the arrow in FIG. 1 (counterclockwise direction) in synchronism with rotation of an intermediate transferring belt 5*a*. A surface of this photosensitive drum 1 is uniformly electrified by an electrifying device 2, and photoirradiation of a yellow image is first performed by exposing means not shown, whereby a yellow electrostatic latent image is formed on the photosensitive member drum 1.

At the same time as this electrostatic latent image formation, a rotary holder (rotary member) 4 constructing rotary type developing device changing means, which will be described in detail later, is driven to place a developing device 4Y of yellow at a developing position (position opposing to the photosensitive drum), and voltage at substantially the same potential with the same polarity as the electrification polarity of the photosensitive drum 1 is applied so that yellow toner adheres to the electrostatic latent image on the photosensitive drum 1, whereby the yellow toner adheres to the electrostatic latent image and developing is performed.

Thereafter, a voltage with a reversed polarity from the toner is applied to a presser roller (primary transferring roller) 5*j* of the intermediate transferring member 5 to perform primary transferring of the toner image of yellow on the photosensitive drum 1 onto the intermediate transferring belt 5*a*.

When the primary transferring of the yellow toner image is finished as described above, the developing devices (4M, 4C, 4K) of the colors of magenta, cyan and black are rotationally moved in succession and positioned at the developing position opposing to the photosensitive drum, then similarly to the case of yellow, formation of an electrostatic latent image, developing, and primary transferring are performed in succession for each of the colors, magenta, cyan and black, and the toner images of four colors are overlaid on the intermediate transferring belt 5*a*.

During this time, a secondary transferring roller 11 is not in contact with the intermediate transferring belt 5*a*. At this time, an electrifying roller 5*f* as a cleaning unit is also at the position not in contact with the intermediate transferring belt 5*a*.

After formation of the toner image of four colors on the intermediate transferring belt 5*a* is completed, the secondary transferring roller 11 is pressed in contact with the intermediate transferring belt 5*a* (the state in FIG. 1), and further in synchronism with the intermediate transferring belt 5*a*, a transferring material S, which waits at a predetermined position near a resist roller pair 7*d* being feeding means, is fed to a nip part of the intermediate transferring belt 5*a* and the secondary transferring roller 11.

Further, a voltage with a reversed polarity from the toner is applied to the secondary transferring roller 11, and the toner image on the intermediate transferring belt 5*a* is secondarily transferred onto a surface of the conveyed transferring material S at one time.

In this manner, the transferring material S for which the secondary transferring is performed, reaches a fixing device 8 via a conveying belt unit 12, and after fixing of the toner image of a plurality of colors is performed at the fixing device 8, the transferring material S is conveyed along a sheet discharging guide 15 by a sheet discharging roller pair 13, and is discharged to a sheet discharging tray 10 at an upper part of the color image forming apparatus by a discharging roller pair 9, whereby image formation is completed.

Meanwhile, a cleaning electrifying roller 5*f* is pressed in contact with the intermediate transferring belt 5*a* after the secondary transferring and gives reverse electric charge from that at the time of transferring to the residual toner remaining on the intermediate transferring belt. Thereafter, the residual toner given the reverse electric charge is made to adhere to the photosensitive member drum 1 electrostatically, and thereafter, the residual toner is recovered by a cleaning blade 6 for the photosensitive drum 1.

The recovered residual toner is recovered and stored in a waste toner box 16 as waste toner.

Next, a rotary construction and rotary drive of the rotary type developing device switching means will be explained.

Figure 2:
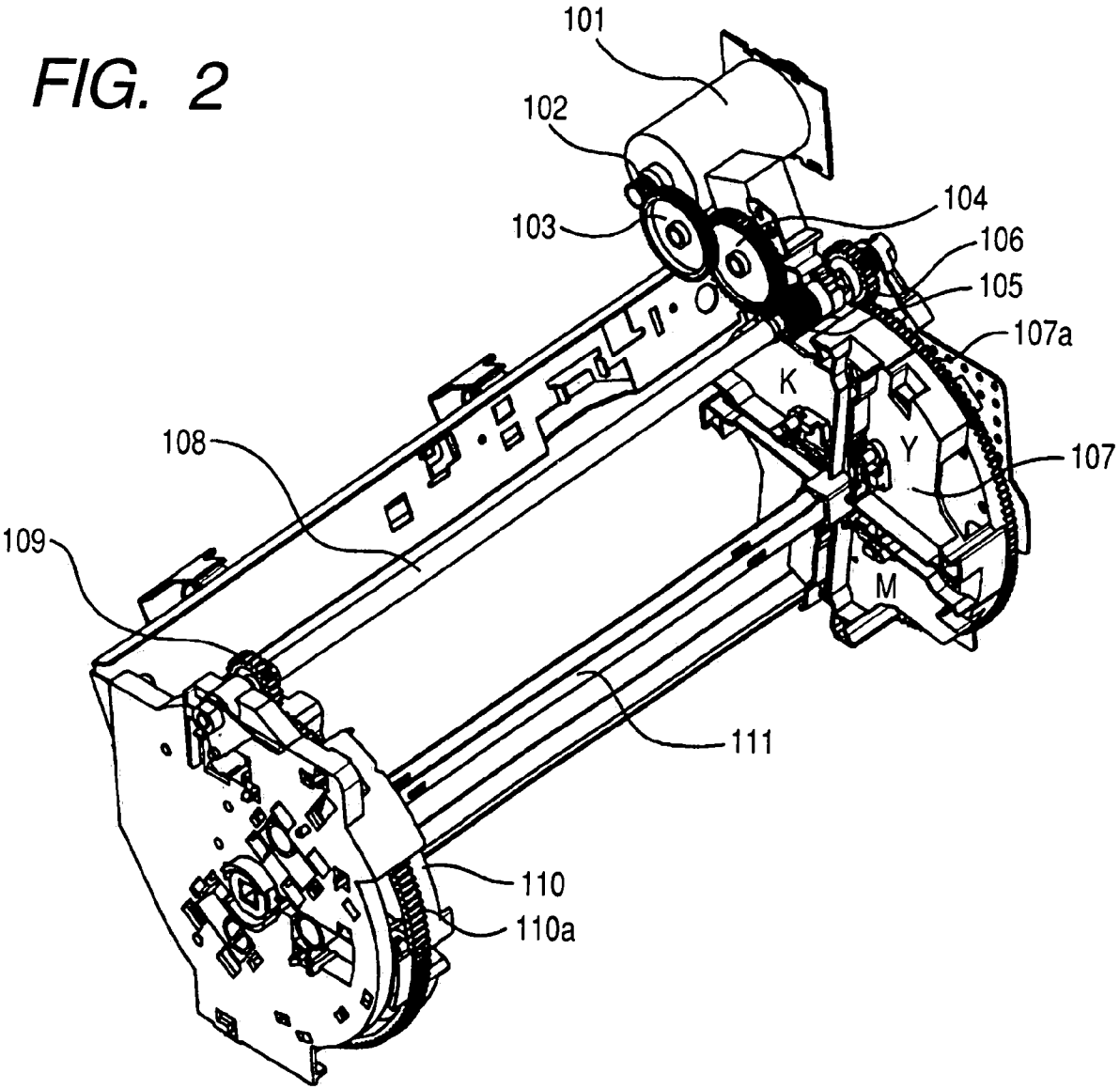
FIG. 2 is a perspective view of an enlarged rotary part of the image forming apparatus according to the embodiment of the present invention.
Figure 3:
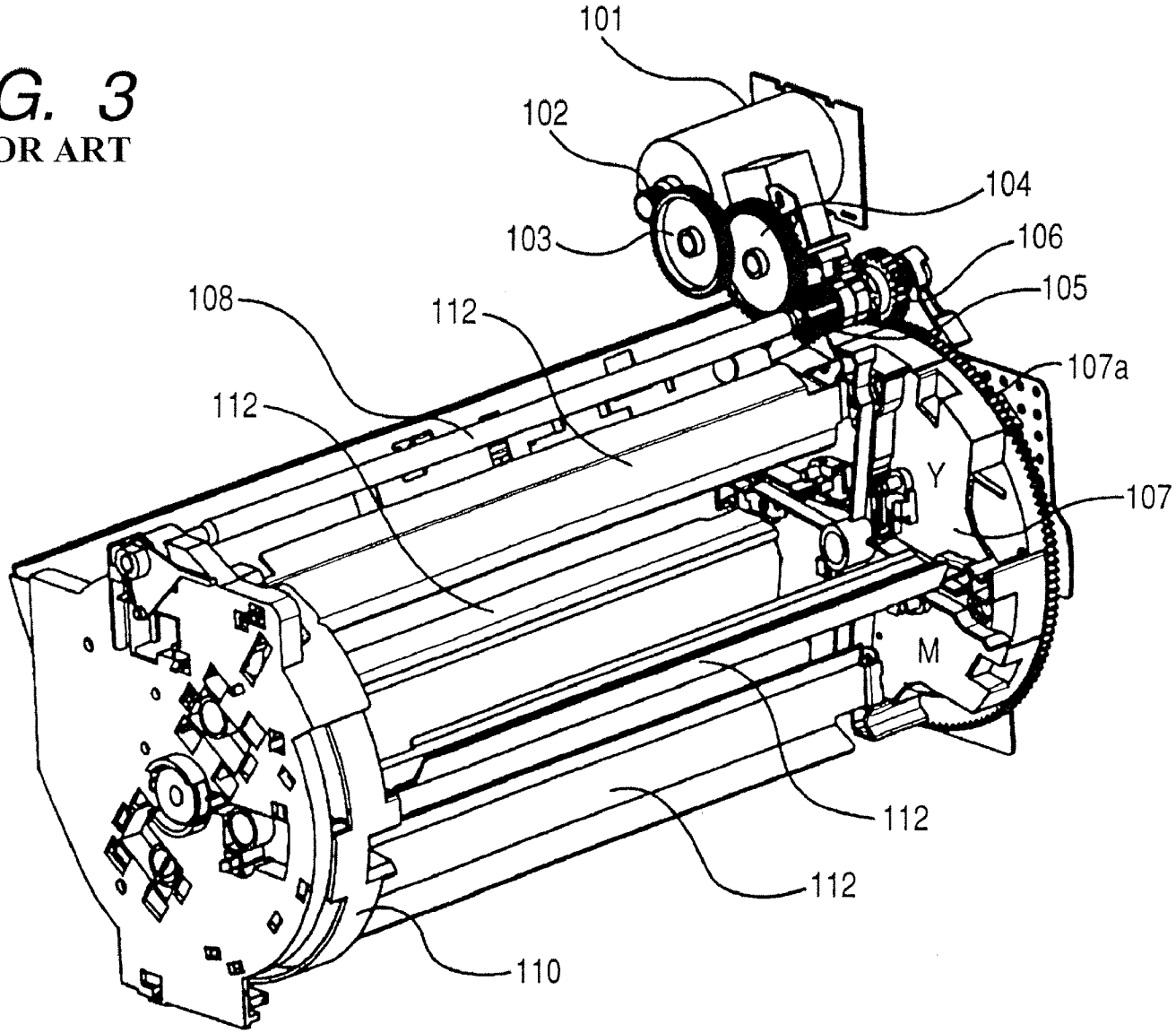
FIG. 3 PRIOR ART
FIG. 3 is a perspective view of an enlarged rotary part of an image forming apparatus according to a prior art.

FIG. 2 is a perspective view showing a schematic construction of a rotary part of the rotary type developing device switching means according to the embodiment of the present invention.

The rotary holder 4 includes a disc 107 (first side plate) and a disc 110 (second side plate), which are a pair of developing device holding means for holding developing cartridges 4Y, 4M, 4C and 4K being developing means, and gears 107*a* and 110*a* which are drive receiving parts formed on circumferential surfaces of the discs 107 and 110, and the rotary holder rotates and stops so that each of the developing cartridge is opposed to the photosensitive member 1 individually. Reference numeral 108 denotes a rotary shaft for connecting a gear 106 (first drive transmitting part) engaged with the gear 107*a* (first drive receiving part), and a gear 109 (second drive transmitting part) engaged with the gear 110*a* (second drive receiving part). This rotary shaft 108 is also provided with a gear 105 for receiving power from the motor 101.

Power for rotating the rotary holder is transmitted from the motor 101, which is a driving source, to the gear 105 of the rotary shaft 108 via a gear 102 mounted to a motor shaft, and gears 103 and 104, which are drive transmitting gears, and further transmitted to the gears 107*a* and 110*a* formed at the pair of discs 107 and 110 by the gears 106 and 109.

Namely, the gears 107*a* and 110*a* formed respectively at the discs 107 and 110, which are the pair of developing device holding means, each have the same number of teeth as a module, and both of the gears 106 and 109 directly meshed with the gears 107*a* and 110*a* also each have the same number of teeth as the module. The gears 106 and 109 are connected by the rotary shaft 108 made of metal bar stock in a state in which they are in phase with each other, and are rotated integrally with each other, and therefore when the drive from the driving source 101 is transmitted, the discs 107 and 110 are rotationally driven in synchronism with each other.

A connecting member 111 for connecting rotation center portions of the discs 107 and 110 is provided to prevent the developing devices falling off as a result that a space between the discs 107 and 110 is open. In this embodiment, the connecting member 111 is a metal member, and its sectional shape is a shape of "ㅋ". The sectional shape is not limited to the shape of "ㅋ", and it may be a rectangular shape such as "□" or the like, as long as the section is in a square shape. The member, which connects the two discs 107 and 110, is only this connecting member 111. The cost can be reduced by using the connecting member 111 with a square-shaped section.

In this embodiment, the rotation center portions of the discs 107 and 110 are connected by the sheet metal member 111 in the shape of "ㅋ", and therefore the discs 107 and 110 can be twisted at several tens degrees with the force of an assembling person. As a result, when the discs 107 and 110 are installed, the discs 107 and 110 are only twisted by a predetermined amount, whereby accurate phasing of both discs can be performed without using a jig as in the prior art, and the space between the discs 107 and 110 is fixed, thus making it possible to prevent the developing devices from falling off at low cost. Since the two discs 107 and 110 are only connected by the connecting member at a center of each of the discs as described above, the number of components of the rotary can be made small, and the weight can be reduced to be small. Since the rigidity of the connecting member is not so high, and both discs can be twisted, phasing of both discs can be performed after both the discs are mounted on the occasion of assembling of the apparatus, and the manufacture cost can be reduced.

By adopting the above construction, the power of the driving source is directly transmitted to the pair of left and right disc members, which hold the developing devices 4Y, 4M, 4C and 4K, at the same time in the same phase by the gears 106 and 109, and are rotationally driven, and therefore at the time of being driven, both discs are rotated and stopped at the position at which the developing can be performed without being twisted, whereby the developing device of each color is held in parallel with respect to the photosensitive member drum 1. As a result, an image of stable picture quality can be outputted. As described above, the apparatus of this embodiment can accurately rotate the rotary even with the rotary at low cost with rigidity which is not so high.

As compared with the conventional image forming apparatus in which a number of reinforcing members of metal sheet and the like are fixed between a pair of left and right disc members of the aforesaid rotary holder, the number of components can be reduced, and the cost can be reduced.

Since assembly with high precision which prevents a twist by using a jig or the like is not required, the apparatus can be easily assembled.

As explained thus far, according to the present invention, a pair of holding members for holding the developing devices 4Y, 4M, 4C and 4K is prevented from being twisted to be driven without being fixed with use of a number of reinforcing members, and therefore the developing devices can be held in parallel with respect to the image bearing member with the simple construction, thus making it possible to output an image of stable picture quality free from an image void.

Since the reinforcing member is not needed, cost can be reduced, and on assembly, it is not necessary to assemble the rotary with high precision with use of a jig or the like, and therefore assembly can be facilitated.

The present invention is not limited to the aforementioned examples, but includes various modifications within the scope of the technical concept.

What is claimed is:

1. An image forming apparatus for forming an image on a recording material, comprising:

an image bearing member;

first developing means for developing a latent image formed on said image bearing member;

second developing means for developing a latent image formed on said image bearing member;

a rotary member for holding said first and second developing means, with a first drive receiving part being provided at a first side plate at one end portion in a longitudinal direction of said rotary member, and a second drive receiving part being provided at a second side plate at the other end portion;

a rotary shaft including a first drive transmitting part engaged with said first drive receiving part, and a second drive transmitting part engaged with said second drive receiving part;

a driving source for driving said rotary shaft, wherein when said rotary shaft is rotated by power of said driving source, the power is transmitted to said first and second drive receiving parts and said rotary member is rotated;

wherein said rotary member includes a connecting member having a "ㅋ" shaped section for connecting a center of said first side plate and a center of said second side plate.

2. The image forming apparatus according to claim 1, wherein said first side plate and said second side plate of said rotary member are connected by only one connecting member at a center.

3. The image forming apparatus according to claim 1, wherein said first and second drive receiving parts are gears, and modules and numbers of teeth of both gears are the same.

4. A color image forming apparatus for forming an image on a transferring member, comprising:

a driving source;

an image carrying member to which an electrostatic latent image is formed; and a rotary holder capable of holding each of a plurality of developing means for developing said electrostatic latent image and of rotating to face each of said plurality of developing means to said image carrying member, said rotary holder including:

a pair of discs for holding said plurality of developing means;

a first pair of gears each provided to each of said pair of discs, for transmitting a driving force from said driving source to said discs to rotate said discs;

a second pair of gears each engaged with each of said first pair of gears to transmit a driving force from said driving source to each of said first pair of gears, a first connecting member connecting said second pair of gears with each other;

wherein said second pair of second gears are connected with each other by said first connecting member to be rotated integrally with each other; and a second connecting member for connecting each of rotation center portions of said pair of discs to fix a space between said pair of discs, said second connecting member having a "ㅋ" shaped cross section and being a metal sheet so that said second connecting member is capable of being twisted by a predetermined amount.

5. The color image forming apparatus according to claim 4, wherein said first pair of gears includes the same number of teeth as a module, and said second pair of gears includes the same number of teeth as a module.

6. The color image forming apparatus according to claim 5, wherein said second pair of gears are connected with each other by said first connecting member in a state in which said second pair of gears are in phase with each other.

7. The color image forming apparatus according to claim 4, wherein said first connecting member comprises a metal bar member.

* * * * *

UNITED STATES PATENT AND TRADEMARK OFFICE

CERTIFICATE OF CORRECTION

PATENT NO. : 7,162,186 B2
APPLICATION NO. : 10/670243
DATED : January 9, 2007
INVENTOR(S) : Toshifumi Moritani It is certified that error appears in the above-identified patent and that said Letters Patent is hereby corrected as shown below:

ON THE TITLE PAGE, AT ITEM (57), Abstract:
Line 2, “developing” (second occurrence) should read --develop--.
Line 4, “device.” should read --devices.--.
Line 10, “is” (second occurrence) should be deleted.
Lines 12-13, close up the vertical space.

COLUMN 4:
Lines 42-43, close up the vertical space.
Lines 43-44, close up the vertical space.
Line 52, close up the vertical space, COLUMN 5:
Line 58, “part;” should read --part; and--.
Line 60, “by power” should read --by the power--.
Line 62, “rotated;” should read --rotated, and--.

COLUMN 6:
Lines 1-2, close up the vertical space.
Line 12, “and modules” should read --and the modules--.
Line 18, “to” should read --on--.
Line 37, “other;” should read --other,--.
Line 38, “second” (second occurrence) should be deleted; and “are” should read --is--.
Line 43, “rotation” should read --the rotation--.
Lines 44-45, close up the vertical space.
Line 55, “are” should read --is--.
Line 57, “are” should read --is--.

Signed and Sealed this

Thirty-first Day of July, 2007

JON W. DUDAS
*Director of the United States Patent and Trademark Office*